US005679021A

United States Patent [19]

Krämer

[11] Patent Number: 5,679,021

[45] Date of Patent: Oct. 21, 1997

[54] SPRING CLAMP ACTUATOR

[75] Inventor: Rudolf Krämer, Lautertal, Germany

[73] Assignee: The Whitaker Corporation, Wilmington, Del.

[21] Appl. No.: 610,904

[22] Filed: Mar. 5, 1996

Related U.S. Application Data

[63] Continuation of Ser. No. 236,603, May 2, 1994, abandoned.

[30] Foreign Application Priority Data

Jun. 4, 1993 [GB] United Kingdom ..... 9311559

[51] Int. Cl.[6] ..... H01R 4/48

[52] U.S. Cl. ..... 439/835; 439/789; 439/828

[58] Field of Search ..... 439/152–160, 439/259, 265, 438–441, 828, 835, 789

[56] References Cited

U.S. PATENT DOCUMENTS

| | | | |
|---|---|---|---|
| 3,474,389 | 10/1969 | Nagano | 439/440 |
| 4,171,861 | 10/1979 | Hohorst | 339/198 |
| 4,354,722 | 10/1982 | Morel | 439/835 |
| 4,767,340 | 8/1988 | Hohorst | 339/200 |
| 4,768,981 | 9/1988 | Hohorst | 339/200 |

FOREIGN PATENT DOCUMENTS

| | | | |
|---|---|---|---|
| 0 052 767-A1 | 6/1982 | European Pat. Off. | H01R 4/48 |
| 32 37 832-A1 | 4/1984 | Germany | H01R 4/48 |
| 34 18 536-A1 | 11/1985 | Germany | H01R 4/48 |
| 3727091 | 2/1989 | Germany | 439/835 |
| 41 02 784-A1 | 8/1992 | Germany | H01R 9/00 |
| 9215982 U | 2/1993 | Germany | H01R 4/48 |

*Primary Examiner*—J. J. Swann
*Attorney, Agent, or Firm*—E. J. Groen

[57] ABSTRACT

An actuator for opening and closing a spring clamp terminal mounted within a connector housing is receivable within a cavity of the housing. The actuator comprises a tapered first camming surface for progressively biasing the spring clamp open, and a second rest surface for maintaining the spring clamp open for reception of a wire without requiring use of the tool. Once the wire has been placed in a wire receiving hole of the spring clamp, the actuator can be released by tilting thereof about a pivot line such that the spring arm of the spring clamp engages the first camming surface hence pushing the actuating means outwardly of the cavity, thereby enabling clamping of the wire.

10 Claims, 5 Drawing Sheets

SPRING CLAMP ACTUATOR

The application is a Continuation of application Ser. No. 08/236,603 filed May 2, 1994, now abandoned.

BACKGROUND OF THE INVENTION

1. Field of the Invention

This invention relates to actuating means for opening an electrical wire spring clamp mounted in a connector housing.

2. Description of the Prior Art

It is well known in the electrical industry, to use spring clamps for connecting electrical wires to an electrical terminal. The spring clamps provide a rapid connection and disconnection system for electrical wires commonly used for example, in large rack and panel connectors whereby the user can easily adapt the wiring to his own needs. The housing and mounting system of such a rack and panel connector could be similar to that described in British patent application 9306176.0.

It is known to have an insert receivable in a cavity of a connector for opening a spring clamp by being depressed, whereby a camming surface thereof resiliently biases the spring clamp open for receiving a wire. The problem with this system, is that the insert must be depressed with a screw driver, for example, and be held depressed to maintain the spring clamp open so that the wire can be inserted, the operator thus needing both hands for this operation. The screwdriver also gets in the way and increases the difficulty of placing the wire in the spring clamp hole. It would thus be desirable to provide a spring clamp actuator that maintains the spring clamp in a fully open wire receiving position without requiring any external means therefor and that can be rapidly and simply released such that the wire is clamped to the spring clamp for electrical connection therewith.

SUMMARY OF THE INVENTION

It is therefore an object of this invention to provide a cost effective and reliable spring clamp actuator that can be easily manipulated for opening and closing of the spring clamp.

It is also an object of this invention to provide an actuator that can maintain the spring clamp open without requiring external means therefor.

The objects of this invention have been achieved by providing actuating means comprising camming means engageable against the spring clamp, the camming means having a first surface for progressively biasing the spring clamp open and a second surface adjacent the first surface for maintaining the spring clamp fully open for receiving the wire without requiring exterior means, the actuating means pivotable whilst in the fully open position such that the spring clamp reengages the first surface thereby enabling the spring clamp to close.

DETAILED DESCRIPTION OF THE PREFERRED EMBODIMENT

Figure 1:
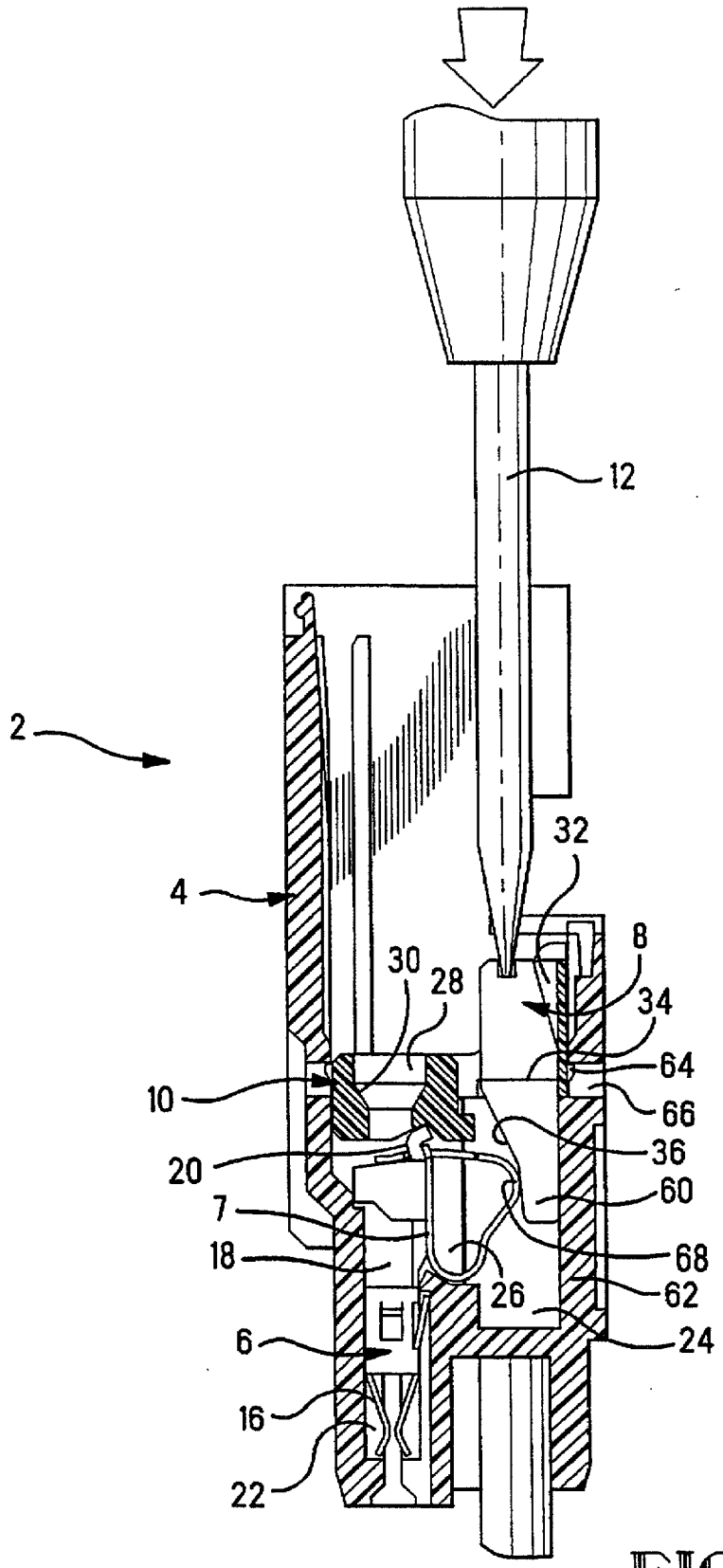
FIG. 1 is a cross sectional view through a connector comprising a spring clamp and spring clamp actuator about to be depressed by a screw driver.
Figure 2:
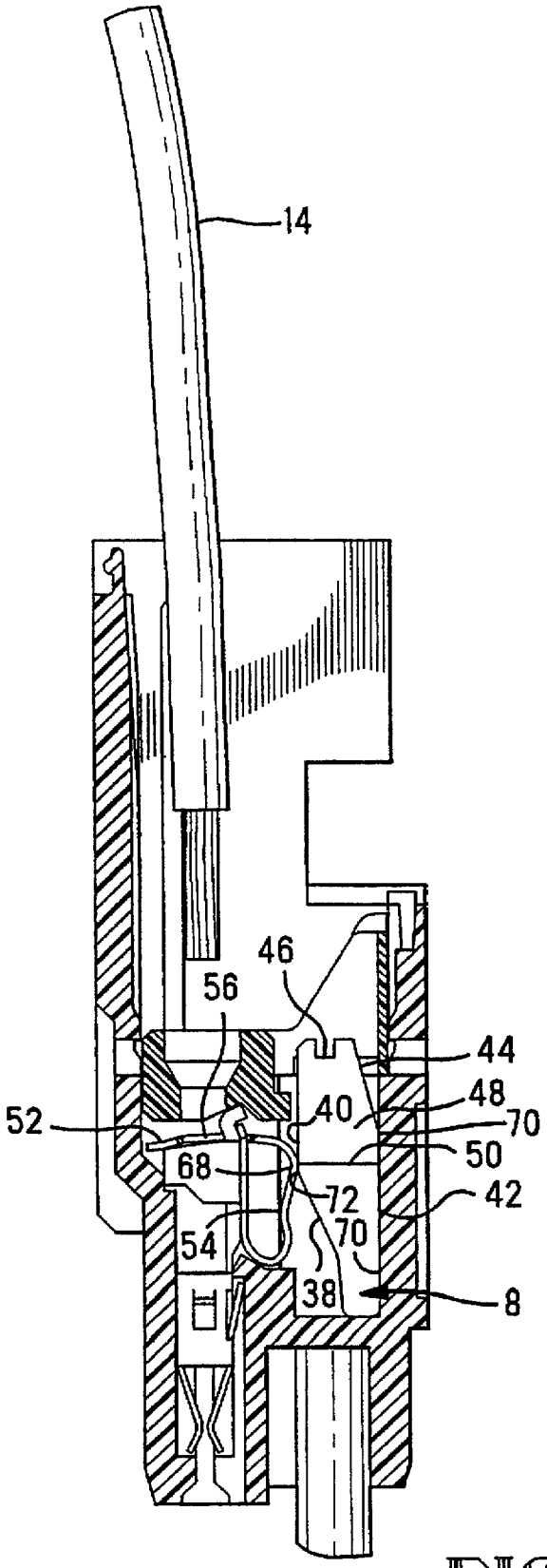
FIG. 2 is similar view to that of FIG. 1 but showing the spring clamp actuator in a fully depressed positioned and the spring clamp fully opened and about to receive a electrical conducting wire.

With reference to FIG. 1 and FIG. 2, an electrical connector generally shown at 2 comprises an insulative housing 4, terminals 6 mounted therein, an actuator 8, and a terminal and actuator cover 10. A screwdriver 12 is also shown for depressing the actuator means 8, and in FIG. 2, an electrical conducting wire 14 for electrical conduction to the terminal 6 is shown.

The terminal 6 comprises a mating connector contact portion 16 for making electrical contact to terminals of a mating connector, and a spring clamp mounting portion 18 having a bent contacting tab 20 for electrically contacting the wire 14. The housing 4 comprises a terminal receiving cavity 22, an actuator receiving cavity 24 and joining the two, a spring clamp receiving cavity portion 26. The inner cover 10, comprises a wire guide hole 28 having a tapered lead surface 30, the hole aligned above the terminal receiving cavity 22, and an actuator receiving hole 32 above the cavity 24, the actuator hole 32 having shoulders 34 for retaining the actuator 8.

Figure 6:
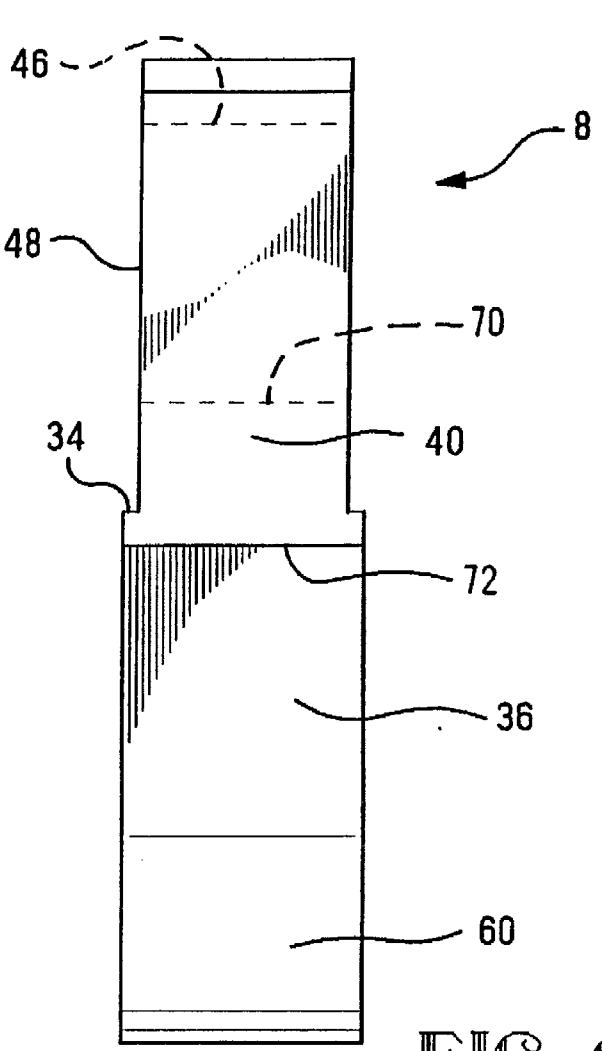
FIGS. 5 and 6 are, respectively, detailed side and front views of the actuator.
Figure 5:
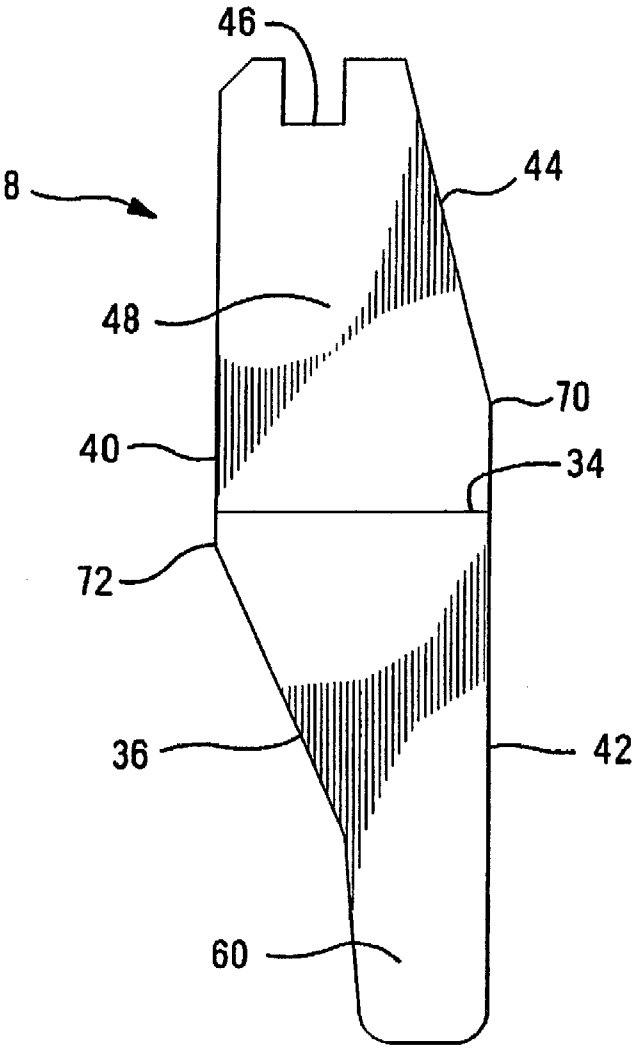

The actuator 8 (see FIGS. 5 and 6) comprises a one piece moulded body having a camming surface 36 comprising a first lower surface 38 for progressive opening of the spring clamp 7 and a second upper surface 40 for maintaining the spring clamp open, a lower back wall support surface 42, an upper back wall tilt surface 44 adjacent the wall 42, an indent 46 at a top end for receiving an exterior tool, and recesses 48 in an upper portion of the actuator 8 forming retention shoulders 50.

The spring clamp 7 comprises a clamping portion 52 attached to a resilient spring arm portion 54, the clamping portion 52 comprising a wire receiving hole 56 around the contacting tab 20 of the terminal 6.

The construction of the terminal 6 and the screw clamp 7 are well known and will not be described herein in any detail. The screw clamp 7 is a separate part from the terminal 6 and securely mounted thereto. In order to assemble the connector 2, the terminal 6 with the spring clamp 7 is inserted respectively into the cavities 22 and 26 until resilient retention means of the terminal 6 engage with shoulder means of the housing 4. The actuator 8 can then be inserted into the cavity 24 of the housing such that a lower portion 60 of the actuator 8 is wedged between the spring arm 54 of the spring clamp 7 and a side wall 62 of the connector housing 4. The inner cover 10 can then be inserted over the terminal 6 and the actuator 8 until projections 64 of the cover 10 engage in windows 66 of the connector housing 4 for securely fixing the cover 10 thereto. The shoulders 34 of the cover 10 abut against the shoulders 50 of the insert 8 for retention thereof within the housing cavity 24.

Connection of the wire 14 to the terminal 6 will now be explained with reference to FIGS. 1–4. In FIG. 1, the actuator 8 is positioned outwardly of the cavity 24 whereby the spring arm 54 is in the fully closed position and rests against the actuator lower portion 60. A tool such as the screwdriver 12 can then be placed in the indent 46 and the actuator depressed therewith such that it is fully inserted into the cavity 24 as seen in FIG. 2; whereby the spring arm 54 having an outward bulge portion 68 at an upper end thereof, is progressively resiliently biased by the tapered first camming surface 38 towards the terminal 6. In the fully inserted or open position as shown in FIG. 2, the bulge portion 68 of the spring arm 54 is resiliently biased against the second camming surface 40 which is parallel to the connector side wall 62, whereby the actuator lower back wall 42 is pressed against the side wall 62. The tool 12 can thus be removed from the indent 46 as there is no force component tending to push the actuator 8 outwardly of the cavity 24.

Figure 3:
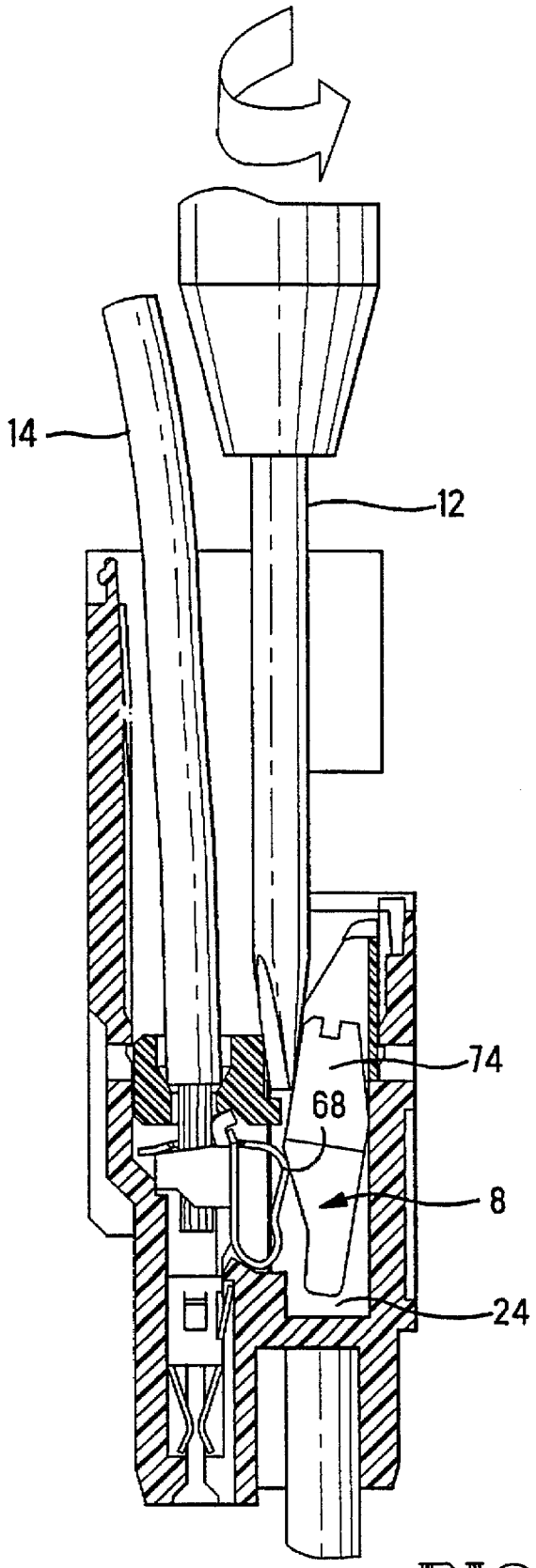
FIG. 3 is a similar cross sectional view to those above but showing the actuator being tilted in order to release the spring clamp such that it can clamp onto the wire.

The intersection between the lower back wall 42 and the slanted upper adjacent wall 44 of the actuator 8 defines a pivot line 70, and the intersection between the first camming surface 38 and the second surface 40 defines a transition line 72, whereby in the fully inserted position, the bulge portion 68 of the spring arm 54 contacts the second surface 40 at the position above the transition line 72 but below the pivot line 70 such that the actuator 8 remains stabily biased against the connector wall 62 without pivoting about the pivot line 70. The wire 14 can thus be inserted into the spring clamp wire receiving hole 56 to a position as shown in FIG. 3.

Figure 4:
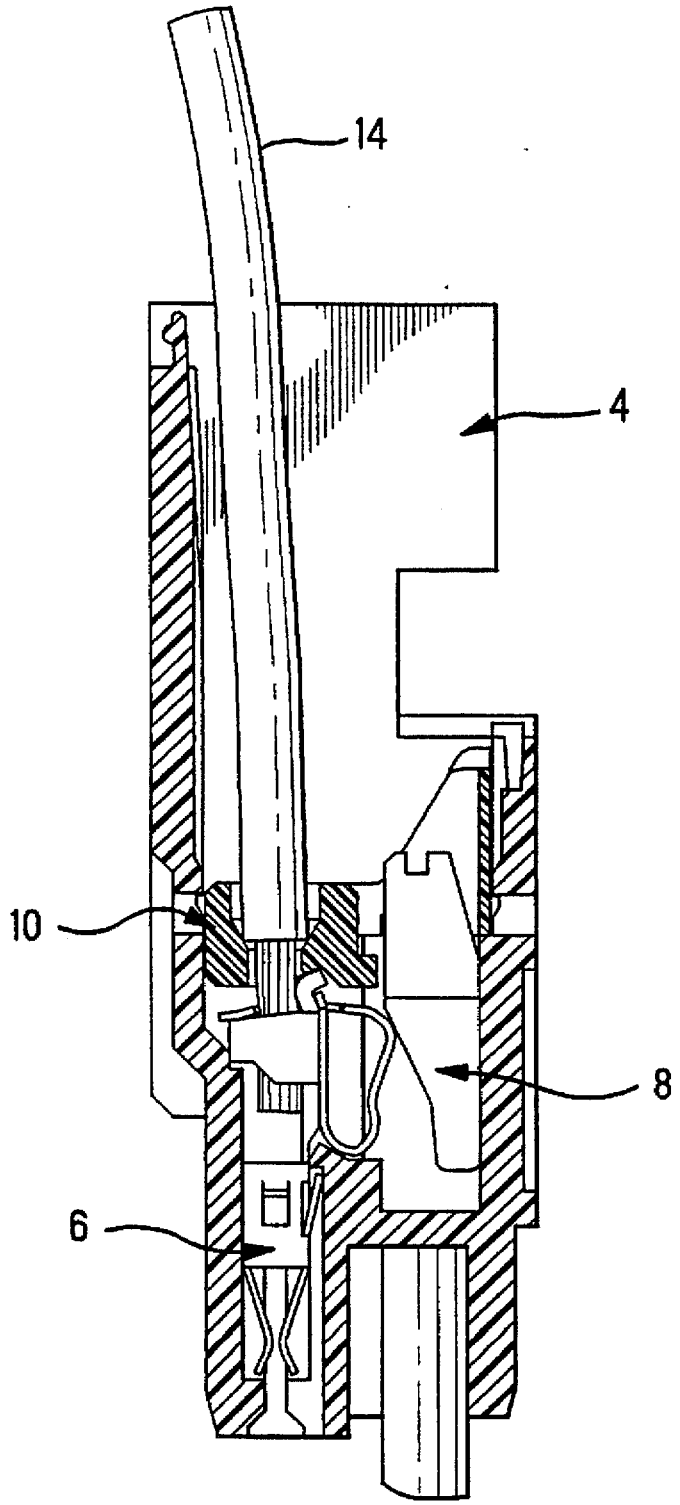
FIG. 4 is a similar cross sectional view to those above but showing the actuator released and the spring clamp clamping the electrical wire.

In order to clamp the wire to the contacting portion 20 of the terminal 6, the actuator means 8 must thus be lifted out of the cavity 24 in order to allow the spring 54 to bias away from the terminal 6 thus clamping the wire. The latter is done by tilting the actuator about the pivot line 70 such that the lower back wall 42 pivots away from the connector side wall 62. This is achieved by inserting the screwdriver 12, for example, between the actuator and a wall of the inner cover 10, and then twisting the screwdriver such that it pushes on an upper portion 74 of the actuator 8 which is above the pivot line 70. By tilting the actuator, the transition line 72 is rotated past the spring arm bulge portion 68 such that the spring arm bulge portion resiliently biases against the first camming surface 38 as shown in FIG. 3. Due to the tapered inclination of the camming surface 38, there is a force component tending to push the actuator 8 outwardly of the cavity 24, the actuator thus moving outwards of the cavity 24 as the spring arm 54 presses against the tapered camming surface 38; and the spring arm 54 biases away from the terminal 6 thus allowing the clamping portion 52 to clamp the wire 14 against the terminal contacting portion 20 as shown in FIG. 4.

Advantageously therefore, the spring clamp can be open for receiving a wire 14, and maintained in the open position without requiring the use of an external tool by providing the actuator means as described above. The wire 14 can then be clamped to the terminal 6 be merely tilting the actuating means 8 in a rapid and simple manner with the tool 12. The actuating means 8 can be made of a single moulded plastic part with simple geometry and also comprising indent means 46 for assisting positioning of a tool 12 during insertion of the actuating means 8 into the housing cavity 24. The connector 2 can comprise a large number of terminals 6 therein, and the rapid manner in which the actuating means 8 can be depressed thus opening the spring clamp which can be done successively for all of the terminals 6, inserting the wires 14 into the holes 56 and then clamping by merely tilting the actuator 8 saves a considerable amount of time and effort compared to solutions of the prior art.

I claim:

1. Actuating means for connecting or disconnecting an electrical wire to a spring clamp mounted in a housing, the housing comprising a cavity for receiving the actuating means adjacent the spring clamp, characterized in that the actuating means comprises camming means slidably engageable against the spring clamp, the camming means having a first surface for progressively biasing the spring clamp open by depressing the actuating means further in the cavity with exterior means, and a second surface engageable against the spring clamp and adjacent the first surface for maintaining the spring clamp fully open for receiving the wire without requiring the exterior means, the actuating means pivotable whilst in the fully open position such that the spring clamp reengages the first surface and presses the actuating means outwardly of the cavity thereby enabling the spring clamp to clamp the wire.

2. The actuating means of claim 1 characterized in that the actuating means is comprised of a single moulded part.

3. The actuating means of claim 2 characterized in that the actuating means has an indent for positioning the exterior means.

4. The actuating means of claim 1 characterized in that the actuating means comprises a lower back surface, adjacent thereto an upper slanted back surface and a pivot line defined by the intersection therebetween; the lower back surface substantially parallel to the camming means second surface and biased against a side wall of the connector housing when the actuating means is in the fully open position, whereby the actuating means is pivotable about the pivot line such that the slanted upper surface rotates towards the connector side wall and the camming means first surface engages with the spring clamp.

5. An electrical connector, comprising:

a housing having a terminal receiving region in communication with an actuator receiving region;

a spring clamp contact for engaging a mating conductor that includes a resilient spring arm portion that is deflectable to open and close the spring clamp contact where the spring clamp contact is positioned in the terminal receiving portion of the housing;

an actuator positioned in the actuator receiving region and having a camming portion thereupon that includes a progressive first surface and a second surface, the camming portion being operatively coupled to the resilient spring arm portion such that as a result of displacement of the actuator the coupling to the first surface enables open position and closing of the contact such that upon reaching a fully opening the contact the second surface is coupled to the resilient spring arm portion in a manner that maintains the open position and in order to release the coupling with the second surface the actuator is tippable within the actuator receiving region such that the coupling is displaced from the second surface to the first surface; whereby as a result of the resiliency of the contact the coupling with the first surface results in movement of the actuator such that the spring contact moves toward the closed position.

6. The electrical connector of claim 5, wherein the resilient spring arm portion is a resilient spring arm bulge that is in direct sliding contact with the camming portion of the actuator.

7. The electrical connector of claim 5, wherein the actuator is a single component.

8. The electrical connector of claim 5, wherein the actuator includes an exterior portion extending from the housing that has an indent thereupon for positioning the actuator.

9. The electrical connector of claim 5, wherein the actuating means comprises a lower back surface and an adjacent upper slanted back surface and the intersection thereof defines a pivot line, where the back surfaces are generally opposite the camming portion and the lower back surface is substantially parallel to the second surface of the camming portion and biased against a wall of the actuator receiving region when the second surface of the actuator is coupled to the resilient spring arm portion while the contact is held in the open position, where the actuator is pivotal about the pivot line such that as the upper slanted surface is moved toward the wall such that the first surface is coupled to the resilient spring arm portion.

10. The electrical connector of claim 9, wherein the resilient spring arm portion is a resilient spring arm bulge that is in direct contact with the actuator and the actuator is formed as a single component that includes exterior portion that extends from the housing and is engageable by exterior means to open and close the spring clamp contact and pivot the actuator in order to release the open position.

* * * * *